US010660404B2

(12) United States Patent
Chen

(10) Patent No.: US 10,660,404 B2
(45) Date of Patent: May 26, 2020

(54) FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 112 days.

(21) Appl. No.: 16/065,134

(22) PCT Filed: Nov. 21, 2016

(86) PCT No.: PCT/CN2016/106648

§ 371 (c)(1),
(2) Date: Jun. 22, 2018

(87) PCT Pub. No.: WO2017/107724

PCT Pub. Date: Jun. 29, 2017

(65) Prior Publication Data

US 2019/0000187 A1 Jan. 3, 2019

(30) Foreign Application Priority Data

Dec. 25, 2015 (CN) ..... 2015 1 0995848

(51) Int. Cl.

| | |
|---|---|
| ***A43C 7/00*** | (2006.01) |
| ***A43C 11/00*** | (2006.01) |
| ***B65H 75/44*** | (2006.01) |
| ***A43C 11/16*** | (2006.01) |
| *B65H 75/36* | (2006.01) |

(52) U.S. Cl.

CPC ..... *A43C 7/00* (2013.01); *A43C 11/008* (2013.01); *A43C 11/165* (2013.01); *B65H 75/4402* (2013.01); *B65H 75/364* (2013.01)

(58) Field of Classification Search

CPC ..... A43C 11/008; A43C 11/165; A43C 7/00; B65H 75/364; B65H 75/4402

See application file for complete search history.

(56) References Cited

U.S. PATENT DOCUMENTS

| | | | | |
|---|---|---|---|---|
| 7,076,843 | B2 * | 7/2006 | Sakabayashi ..... | A43C 7/00 24/68 SK |
| 7,591,050 | B2 * | 9/2009 | Hammerslag ..... | A43B 5/16 24/68 SK |

(Continued)

FOREIGN PATENT DOCUMENTS

| | | | |
|---|---|---|---|
| CN | 1618363 | A | 5/2005 |
| CN | 201718602 | U | 1/2011 |

(Continued)

*Primary Examiner* — Robert Sandy
*Assistant Examiner* — David M Upchurch
(74) *Attorney, Agent, or Firm* — CKC & Partners Co., LLC

(57) ABSTRACT

A fastening device includes a main part and a fastening member. The main part is composed of a base, a spool, a knob and an engaging unit. The fastening member disposed at the main part. The spool is disposed at the base. The knob disposed at the base includes a spiral track. The engaging unit coupled to the spool includes a guiding portion coupled to the spiral track. The guiding portion is limitedly moved along the spiral track by rotating the knob such that the engaging unit has a first position and a second position relative to the knob. The engaging unit prohibits the spool from rotating toward a releasing direction when the engaging unit is at the first position, and the engaging unit allows the spool to be rotated toward the releasing direction when the engaging unit is at the second position.

13 Claims, 15 Drawing Sheets

100

(56) References Cited

U.S. PATENT DOCUMENTS

| | | | | |
|---|---|---|---|---|
| 8,468,657 | B2 * | 6/2013 | Soderberg | A43C 11/16 24/68 SK |
| 8,516,662 | B2 * | 8/2013 | Goodman | A43C 11/165 24/68 SK |
| 9,408,438 | B2 * | 8/2016 | Chen | A43C 11/165 |
| 9,635,906 | B2 * | 5/2017 | Midorikawa | A43C 11/165 |
| 9,743,714 | B2 * | 8/2017 | Hammerslag | A43B 5/16 |
| 10,039,345 | B2 * | 8/2018 | Ha | A43C 7/08 |
| 10,051,920 | B2 * | 8/2018 | Chen | A43C 1/00 |
| 10,470,525 | B2 * | 11/2019 | Chen | A43C 7/00 |
| 2014/0359981 | A1 | 12/2014 | Cotterman et al. | |
| 2015/0014463 | A1 * | 1/2015 | Converse | A61C 7/026 242/396.1 |
| 2015/0191326 | A1 * | 7/2015 | Hall | A42B 3/08 242/396.4 |
| 2015/0342303 | A1 * | 12/2015 | Soderberg | A43C 11/165 24/68 SK |
| 2016/0120267 | A1 * | 5/2016 | Burns | A44B 11/065 24/68 C |
| 2017/0027287 | A1 * | 2/2017 | Burns | A43B 13/14 |
| 2017/0303643 | A1 * | 10/2017 | Converse | A43C 11/165 |
| 2017/0304102 | A1 * | 10/2017 | Turrini | A61F 5/0111 |
| 2017/0325548 | A1 * | 11/2017 | Ha | A43C 11/165 |

FOREIGN PATENT DOCUMENTS

| | | | |
|---|---|---|---|
| CN | 103153112 | A | 6/2013 |
| CN | 203492894 | U | 3/2014 |
| CN | 204895922 | U | 12/2015 |
| DE | 202011101828 | U1 | 8/2011 |
| EP | 0651954 | A1 | 5/1995 |
| JP | 2013525007 | A | 6/2013 |
| JP | 2015000293 | A | 1/2015 |
| TW | M316639 | U | 8/2007 |
| TW | 201228606 | A | 7/2012 |
| TW | M447696 | U | 3/2013 |
| TW | 201429420 | A | 8/2014 |
| TW | M514461 | U | 12/2015 |
| WO | 2004110197 | A2 | 12/2004 |
| WO | 2015035885 | A1 | 3/2015 |

* cited by examiner

FASTENING DEVICE

RELATED APPLICATIONS

This application is a continuation of International application No. PCT/CN2016/106648, filed Nov. 21, 2016, which claims the benefits of priority of CN application No. 201510995848.7 filed on Dec. 25, 2015, the content of which are incorporated herein by reference.

BACKGROUND

Technical Field

The present disclosure relates to a fastening device, and more particularly, the present disclosure relates to a fastening device for tightening and releasing a lace.

Description of Related Art

In daily life, cords, such as a lace or a thread, are usually used to tighten articles. The most common tightening method is to use the cord to reciprocately pass through holes on the article, such as eyelets of a shoe, and then tie a knot to secure the article. But in this kind of tightening method, the knot is loosened easily because of an external force. Not only does the knot need to be tied again, but also lots of inconveniences come owning to the insecurity of the articles.

In order to solve such problems, some practitioners developed a sample fastening mechanism including a case, an engaging unit and a spring. The case includes holes to allow the lace to pass through. Through the reaction force between the spring and the engaging unit, the lace can be clamped between the engaging unit and the case so as to be fastened. The length of the lace can be changed by pressing the spring to change the position of the engaging unit. However, in such fastening mechanism, the restoring force of the spring is served as the securing force; thus, the lace is easily to be released due to vibrations or an external force. In addition, the fastening mechanism has no space to receive the lace, and the exposure of the lace may bring danger.

Therefore, some practitioners develop another kind of buckle which can be rotated to tighten the lace, and the lace can be received inside the buckle. Through the interference between components inside the buckle, the length of the lace as well as the tightness can be adjusted. However, the structure of the buckles is complex; as a result, the manufacturing cost is increased, and the buckle has assembly and repair difficulty.

Base on the above-mentioned problems, how to simplify the structure of the fastening device, reduce the manufacturing cost and maintain the securing capability becomes a pursuit target for practitioners.

SUMMARY

Disclosure of Invention

The present disclosure provides a fastening device, which can move the engaging unit by rotating the knob through the cooperation between the spiral track of the knob and the guiding portion of the engaging unit, and the engaging condition between the engaging unit and the spool is changed, so as to tight or release an article, so the simplifying purpose of the structure can be achieved.

The present disclosure provides another fastening device including a main part and a fastening member. The main part is composed of a base, a spool, a knob and an engaging unit, and the fastening member is disposed at the main part such that the base, the spool, the knob and the engaging unit are assembled. The spool is disposed at the base, and a lace is wound around the spool. The knob is disposed at the base and includes a spiral track. The engaging unit is coupled to the spool and includes a guiding portion coupled to the spiral track. The guiding portion is limitedly moved along the spiral track by rotating the knob such that the engaging unit has a first position and a second position relative to the knob. The engaging unit prohibits the spool from rotating toward a releasing direction when the engaging unit is at the first position, and the engaging unit allows the spool to be rotated toward the releasing direction when the engaging unit is at the second position.

Therefore, the guiding portion of the engaging unit is coupled to the spiral track such that the guiding portion is moved along the spiral track to change the position of the engaging unit; as a result, the engaging unit is switchable between a lace fastening condition and a lace releasing condition. Furthermore, if the main part of the fastening device is composed of the base, the spool, the knob and the engaging unit, the structure of the fastening device can be simplified to decrease the manufacturing difficulty as well as the cost.

According to the aforementioned fastening device, wherein the engaging unit can further include a pawl arm, and one of the base and the spool can include a plurality of inner teeth. When the engaging unit is at the first position, the pawl arm is engaged with the inner teeth in the releasing direction to prohibit the spool from rotating, and the pawl arm is disengaged with the inner teeth in a tightening direction opposite to the releasing direction. In one embodiment, the engaging unit can further include a first retaining portion and a second retaining portion. The engaging portion is ring-shaped and has a radial direction. Each of the first retaining portion and the second retaining portion has a restoring capability in the radial direction. In one embodiment, an anti-deformed capability along the radial direction of each of the first retaining portion and the second retaining portion is smaller than an anti-deformed capability along the radial direction of the pawl arm. In one embodiment, the knob can further include two engaging portions, and the two engaging portions abut the first retaining portion and the second retaining portion, respectively, when the engaging unit is at the first position.

The present disclosure provides a fastening device including a base, a spool, a knob and an engaging unit. The spool is disposed at the base, and a lace is wound around the spool. The knob is disposed at the base and includes a spiral track. The engaging unit is coupled to the spool and includes a guiding portion and a first retaining portion. The guiding portion is coupled to the spiral track. The first retaining portion is coupled to the knob or the base. The guiding portion is limitedly moved along the spiral track by rotating the knob, such that the engaging unit has a first position and a second position relative to the knob. The first retaining portion is coupled to the knob or the base to allow the engaging unit to be remained at the first position or the second position. The engaging unit allows the spool to be rotated toward a releasing direction when the engaging unit is at the second position, and the engaging unit prohibits the spool from rotating toward the releasing direction when the engaging unit is at the first position.

According to the aforementioned fastening device, wherein the engaging unit can further include a pawl arm. One of the base and the spool can include a plurality of inner teeth. When the engaging unit is at the first position, the pawl arm is engaged with the inner teeth in the releasing direction to prohibit the spool from rotating, and the pawl arm is disengaged with the inner teeth in a tightening direction opposite to the releasing direction. In one embodiment, the engaging unit can further include a second retaining portion. The engaging unit is ring-shaped and has a radial direction. Each of the first retaining portion and the second retaining portion has a restoring capability in the radial direction. In one embodiment, an anti-deformed capability along the radial direction of each of the first retaining portion and the second retaining portion is smaller than an anti-deformed capability along the radial direction of the pawl arm. In one embodiment, the knob can further include two engaging portions, and the engaging portions abut the first retaining portion and the second retaining portion, respectively, when the engaging unit is at the first position. In one embodiment, the engaging unit can further include a plurality of engaged teeth. The spool includes a plurality of mounted teeth, and the mounted teeth are engaged with the engaged teeth when the engaging unit is at the first position.

According to the aforementioned fastening device, wherein the base can include a plurality of inner teeth. The engaging unit can further include a lifted member and an engaging member. The guiding portion and the engaged teeth are located at the lifted member. The engaging member is coupled to the lifted member and includes the first retaining portion and a plurality of pawl arms. When the engaging unit is at the first position, the pawl arms are engaged with the inner teeth in the releasing direction to prohibit the spool from rotating, and the pawl arms are disengaged with the inner teeth in a tightening direction opposite to the releasing direction. The first retaining portion is coupled to the knob to allow the engaging unit be remained at the first position. In one embodiment, when the engaging unit is at the second position, the engaged teeth are disengaged with the mounted teeth.

DETAILED DESCRIPTION

The embodiments will be described with the drawings. For clarity, some practical details will be described below. However, it should be noted that the present disclosure should not be limited by the practical details. In other words, in some embodiments, the practical details are unnecessary. In addition, for simplifying the drawings, some conventional structures and elements will be simply illustrated; and repeated elements may be represented by the same labels.

Figure 1:
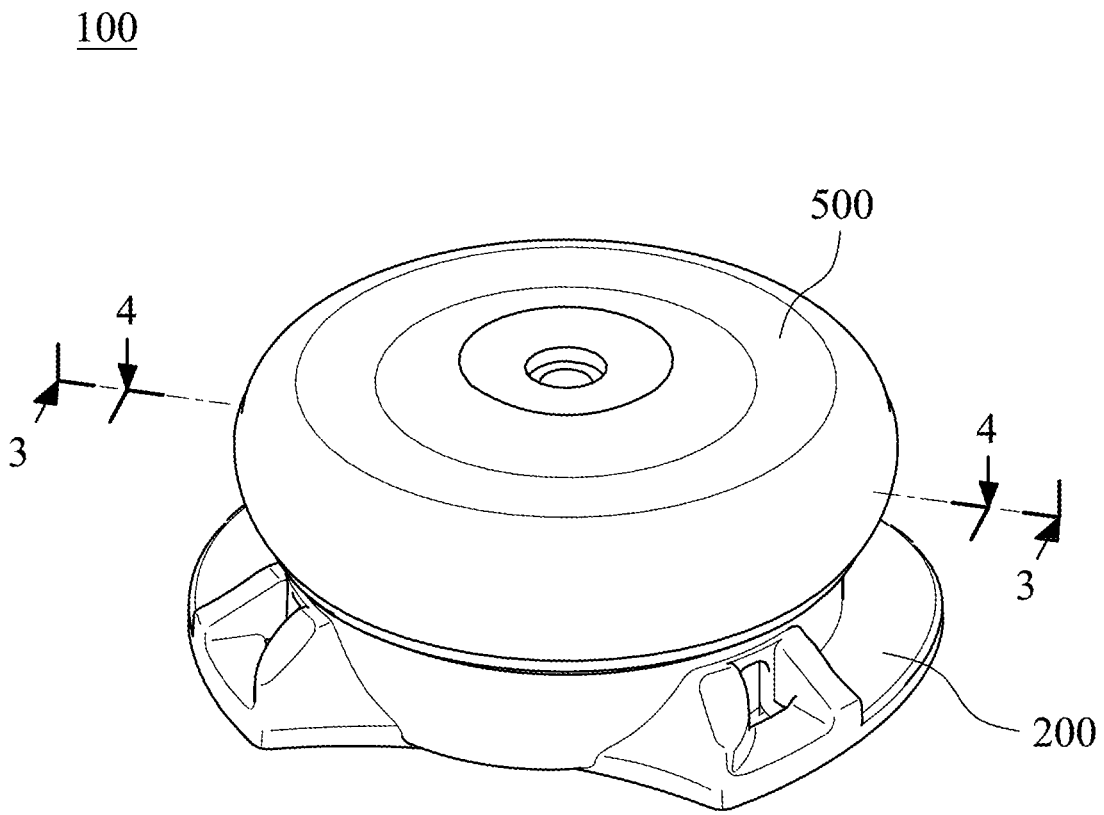
FIG. 1 shows a three-dimensional schematic view of a fastening device according to one embodiment of the present disclosure.
Figure 2A:
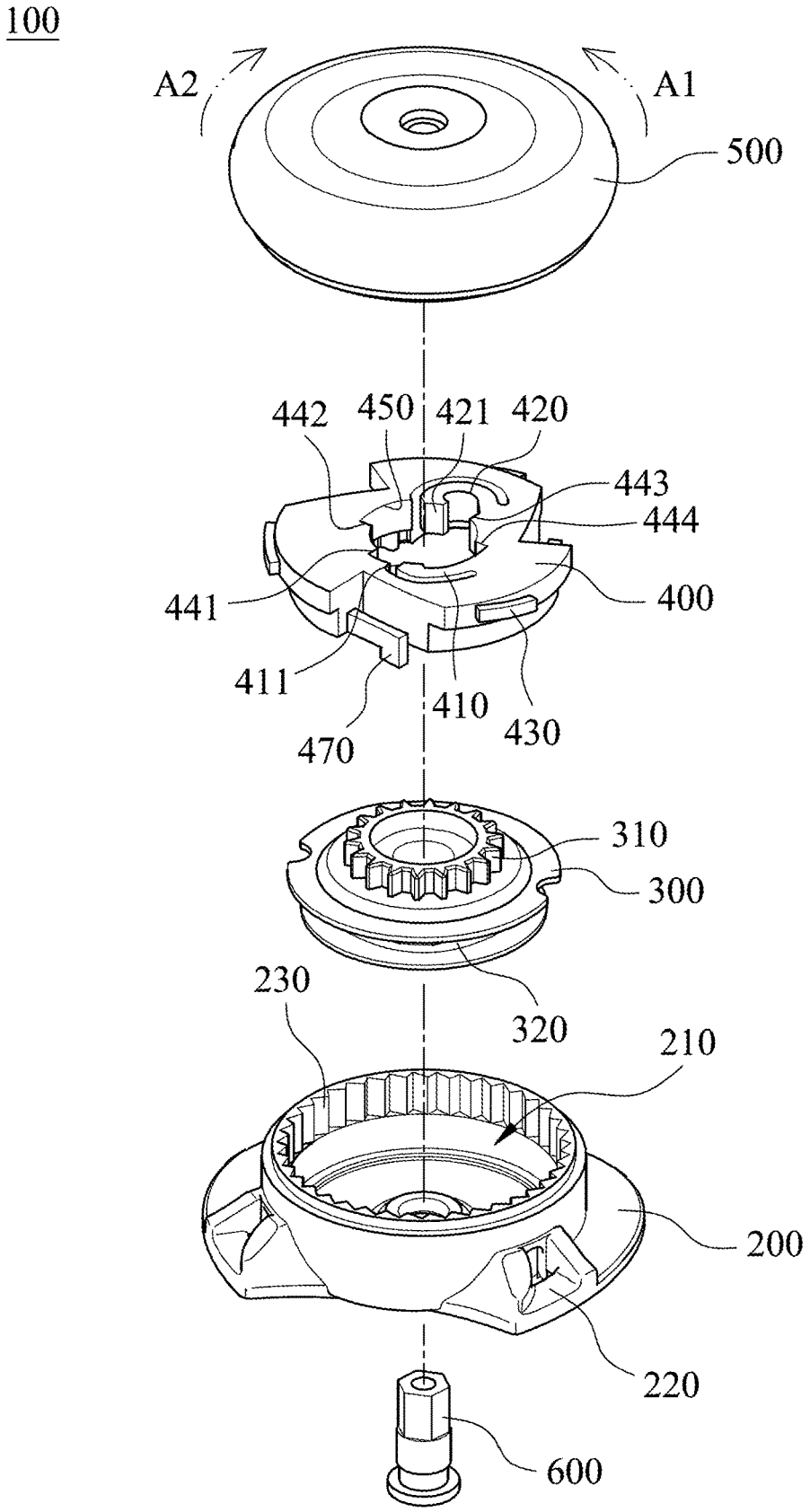
FIG. 2A shows one exploded view of the fastening device of FIG. 1.
Figure 2B:
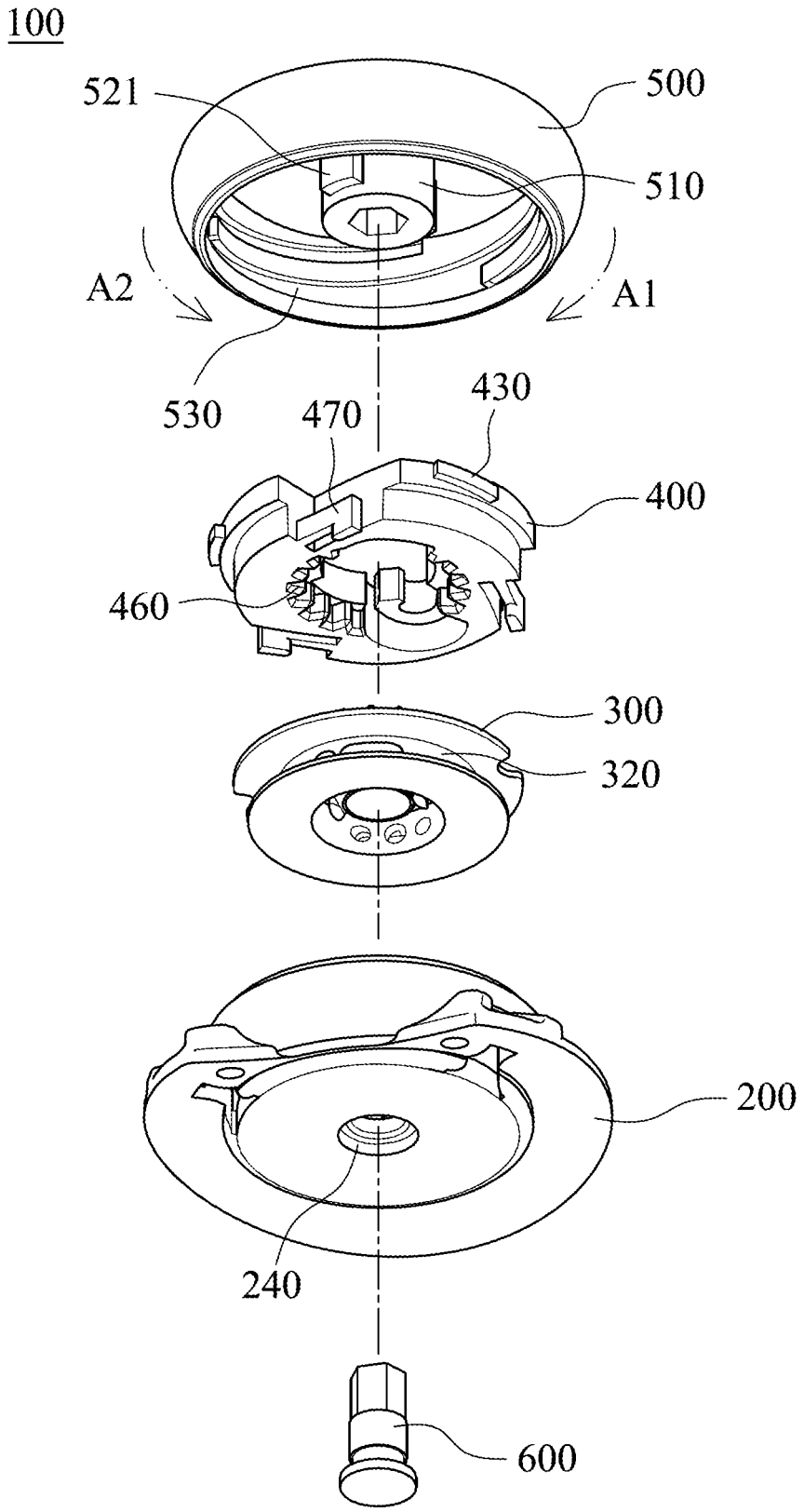
FIG. 2B shows another exploded view of the fastening device of FIG. 1.

Please refer to FIG. 1, FIG. 2A and FIG. 2B, wherein FIG. 1 shows a three-dimensional schematic view of a fastening device 100 according to one embodiment of the present disclosure, FIG. 2A shows one exploded view of the fastening device 100 of FIG. 1, and FIG. 2B shows another exploded view of the fastening device 100 of FIG. 1. The fastening device 100 includes a base 200, a spool 300, a knob 500 and an engaging unit 400, the spool 300 is disposed at the base 200 and a lace (not shown) is wound therearound, the knob 500 is disposed at the base 200 and includes a spiral track 530 (shown in FIG. 2B), the engaging unit 400 is coupled to the spool 300 and includes a guiding portion 430 coupled to the spiral track 530; the guiding portion 430 is limitedly moved along the spiral track 530 by rotating the knob 500, such that the engaging unit 400 has a first position and a second position relative to the knob 500, the engaging unit 400 prohibits the spool 300 from rotating toward a releasing direction A1 when the engaging unit 400 is at the first position, and the engaging unit 400 allows the spool 300 to be rotated toward the releasing direction A1 when the engaging unit 400 is at the second position.

Therefore, the guiding portion 430 of the engaging unit 400 is coupled to the spiral track 530, and is moved along the spiral track 530 such that the position of the engaging unit 400 can be changed, so the lace can be tightened or released. The structure and operation of the embodiment will be described in detail in the following paragraphs.

The base 200 has a case structure, and includes a receiving space 210, a plurality of inner teeth 230, two lace holes 220 and an opening 240 (shown in FIG. 2B). The inner teeth 230 face toward the receiving space 210, the two lace holes 220 and the opening 240 are communicated with the receiving space 210, and two ends of the lace pass through the two lace holes 220, respectively, to be connected to the spool 300.

The spool 300 is disc-shaped, and includes an annular track 320 and a plurality of mounted teeth 310, the spool 300 is disposed inside the receiving space 210, the lace is wound around the annular track 320, and the mounted teeth 310 are configure to be coupled to the engaging unit 400.

The engaging unit 400 is ring-shaped and has a radial direction (not shown), and the engaging unit 400 includes a first retaining portion 410, a second retaining portion 420, three guiding portions 430, four stopping portions 441, 442, 443, 444, a communicating hole 450, a plurality of engaged teeth 460 and three pawl arms 470. Each of the guiding portions 430 has an inclined block structure and is coupled to the spiral track 530, and the pawl arms 470 are configured for engaging with the inner teeth 230. The engaged teeth 460 are disposed at a wall of the communicating hole 450, which is near the base 200, and the four stopping portions 441, 442, 443, 444 are protruded from the wall of the communicating hole 450, which is near the knob 500, toward a center of the engaging unit 400 along the radial direction, and the positions of the stopping portions 441, 443 are relative to each other, the positions of the stopping portions 442, 444 are relative to each other.

Each of the first retaining portion 410 and the second retaining portion 420 can be deformed and can restore in the radial direction, precisely, the first retaining portion 410 has a first free end 411, and the second retaining portion 420 has a second free end 421, when each of the first free end 411 and the second free end 421 bears a force exerted thereon is larger than the force they can bear, they would be deformed in the radial direction, and when the external force is removed, the first free end 411 and the second free end 421 restore.

The knob 500 includes a cylinder 510, two engaging portions 521, 522 (shown in FIG. 4B) and the spiral track 530. The cylinder 510 is protruded toward the base 200, the two engaging portions 521, 522 are disposed at the cylinder 510 and the positions thereof are symmetrical to each other, the cylinder 510 and the engaging portions 521, 522 are protruded into the communicating hole 450 when assembling, when the engaging unit 400 is at the first position, the engaging portion 521 is pushed against the first retaining portion 410, and the engaging portion 522 is pushed against the second retaining portion 420. The spiral track 530 is disposed at an inner wall (not labeled) of the knob 500 and coupled to the guiding portion 430.

The main part (not labeled) of the fastening device 100 includes the base 200, the spool 300, the knob 500 and the engaging unit 400, and in addition to the main part, the fastening device 100 further includes a fastening member (not labeled) disposed at the main part such that the base 200, the spool 300, the knob 500 and the engaging unit 400 are assembled. In the embodiment, the fastening member includes a connecting post 600 and a screw (not shown), the connecting post 600 passes through the opening 240, the spool 300 and the communicating hole 450 to engage with the cylinder 510, and then the screw is fastened into the connecting post 600 to complete the assembly of the fastening device 100. In other embodiments, a protruding post (not shown) can protrude from the base 200 of the main part toward the knob 500, and the protruding post passes through the spool 300, the knob 500 and the engaging unit 400, and the fastening member has a screw structure, which can connect the elements by locking into the protruding post from the knob 500.

Figure 3A:
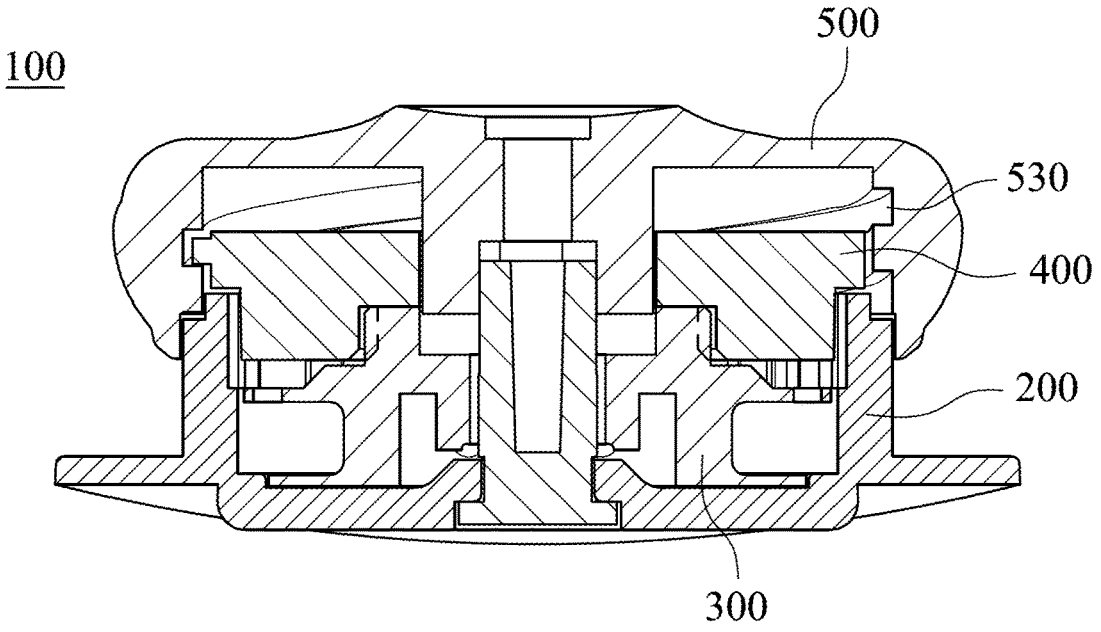
FIG. 3A shows one cross-sectional view of the fastening device of FIG. 1 taken along Line 3-3.
Figure 3B:
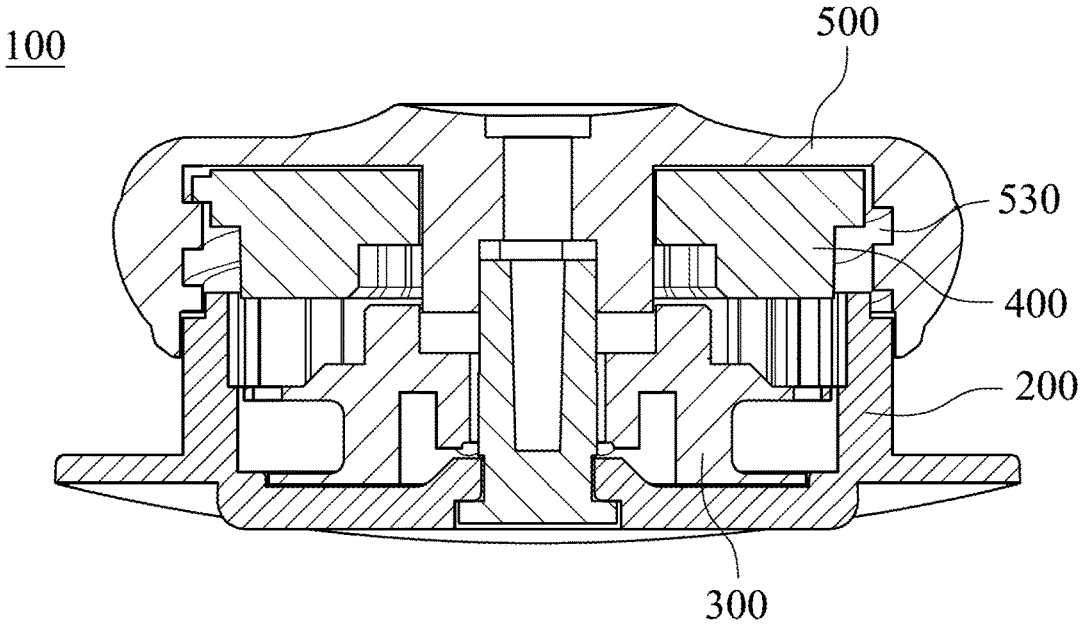
FIG. 3B shows another cross-sectional view of the fastening device of FIG. 1 taken along Line 3-3.

Please refer to FIG. 3A and FIG. 3B, and also refer to FIG. 2A and FIG. 2B, wherein FIG. 3A shows one cross-sectional view of the fastening device 100 of FIG. 1 taken along Line 3-3, and FIG. 3B shows another cross-sectional view of the fastening device 100 of FIG. 1 taken along Line 3-3.

As shown in FIG. 3A, the guiding portion 430 (shown in FIG. 2B) can be limitedly moved along the spiral track 530, in other words, the guiding portion 430 can be moved along the spiral track 530 when the knob 500 is rotated relative to the engaging unit 400, such that the engaging unit 400 can be lifted or lowered relative to the knob 500. As shown in FIG. 3A, the engaging unit 400 is at the first position, and the pawl arms 470 (shown in FIG. 2B) are relative to the inner teeth 230 (shown in FIG. 2A), and the engaged teeth 460 (shown in FIG. 2A) are engaged to the mounted teeth 310 (shown in FIG. 2A). The pawl arms 470 (shown in FIG. 2A) will be disengaged with the inner teeth 230 in the tightening direction A2 (shown in FIG. 2A) while engaged with the inner teeth 230 in the releasing direction A1 (shown in FIG. 2A) owning to the structure thereof, such that the engaging unit 400 can be driven to link up with the spool 300 by rotating the knob 500 toward the tightening direction A2, such that the lace is retracted, and when the knob 500 is stopped, the pawl arms 470 are engaged with the inner teeth 230 to prohibit the spool 300 from rotating toward the releasing direction A1, such that securing purpose is achieved.

As shown in FIG. 3B, when the guiding portion 430 is moved to switch the engaging unit 400 to the second position by rotating the knob 500, the pawl arms 470 are disengaged with the inner teeth 230, because the pawl arms 470 are disengaged with inner teeth 230, the rotation of the spool 300 toward the releasing direction A1 is not restricted, and the lace can be pulled so as to be released. In the embodiment, the engaging unit 400 is not coupled to the spool 300 when the engaging unit 400 is at the second position and the engaged teeth 460 are disengaged with the mounted teeth 310, however, in other embodiments, the engaged teeth 460 can be still engaged with the mounted teeth 310 while the pawl arms 470 are disengaged with the inner teeth 230, and further the inner teeth 230 can be, but not limited to, disposed at the spool 300.

Figure 4A:
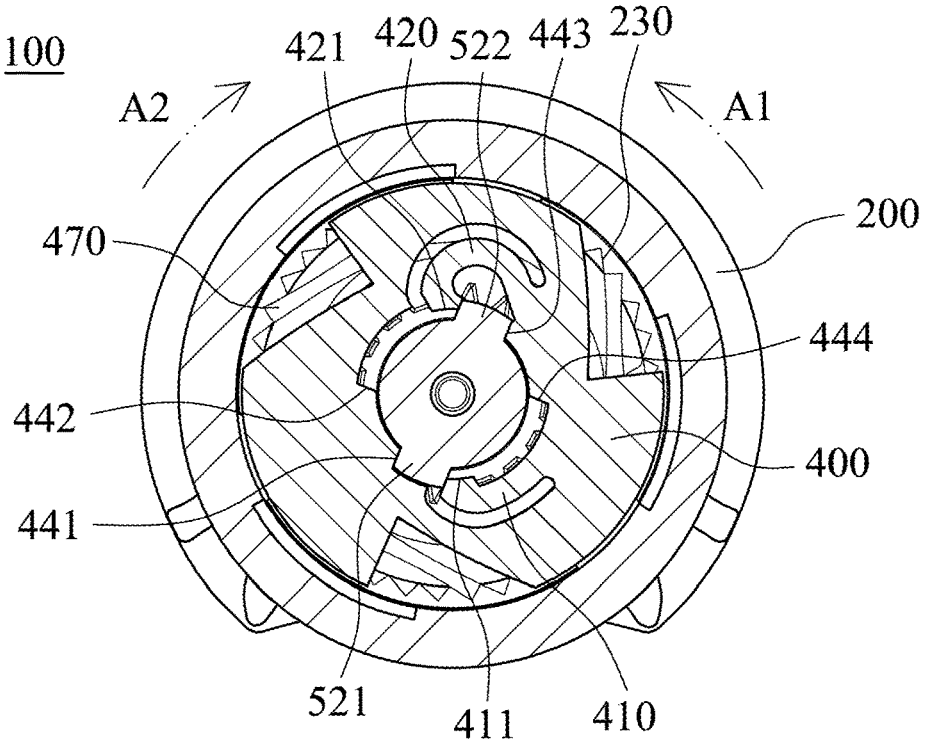
FIG. 4A shows one cross-sectional view of the fastening device of FIG. 1 taken along Line 4-4.
Figure 4B:
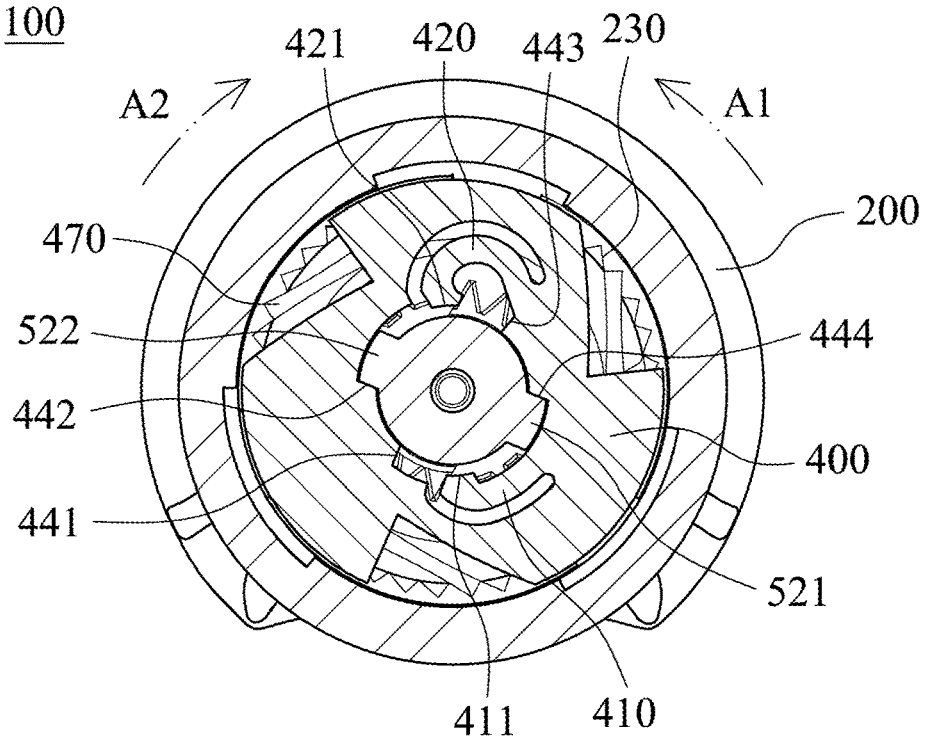
FIG. 4B shows another cross-sectional view of the fastening device of FIG. 1 taken along Line 4-4.

Please refer to FIG. 4A and FIG. 4B, wherein FIG. 4A shows one cross-sectional view of the fastening device 100 of FIG. 1 taken along Line 4-4, FIG. 4B shows another cross-sectional view of the fastening device 100 of FIG. 1 taken along Line 4-4.

As shown in FIG. 4A, the engaging unit 400 is at the first position, the engaging portion 521 is abutted against the first retaining portion 410 and the stopping portion 441, and the engaging portion 522 is abutted against the second retaining portion 420 and the stopping portion 443. As a result, the knob 500 (shown in FIG. 2A) is engaged with the engaging unit 400, such that when the engaging unit 400 is rotated in the tightening direction A2, the engaging portion 521 presses the stopping portions 441, the engaging portion 522 presses the stopping portions 443, to rotate the engaging unit 400. In another hand, when the knob 500 is stopped, due to the structure arrangements of the first retaining portion 410 and the second retaining portion 420, the engaging portion 521 and the engaging portion 522 can be abutted for positioning the relative position of the knob 500 and the engaging unit 400, such that it is favorable for preventing the position of the knob 500 and the engaging unit 400 from being moved by the external force (which is a vibrating force in the environment during using, but not the force applied by the user) to lead the lace to be released.

When the knob 500 is rotated toward the releasing direction A1, owing to the engagement between the pawl arms 470 and the inner teeth 230, rotation of the engaging unit 400 is restricted, such that the engaging portion 521 presses the first free end 411 of the first retaining portion 410 when forced, the engaging portion 522 presses the second free end 421 of the second retaining portion 420 when forced, as a result, the first free end 411 and the second free end 421 are moved in the radial direction because the first free end 411 and the second free end 421 cannot bear the force, as shown in FIG. 4B, the knob 500 can be rotated relative to the engaging unit 400 to allow the engaging portion 521 to be abutted by the stopping portion 444 and the engaging portion 522 to be abutted by the stopping portion 442, and when the force acted on the first free end 411 and the second free end 421 is disappeared, the first free end 411 and the second free end 421 will restore. Hence, when the knob 500 is rotated relative to the engaging unit 400, the guiding portion 430 can be moved along the spiral track 530, and the engaging unit 400 can change from the first position to the second position.

In addition, if the knob 500 is rotated in the tightening direction A2, the engaging portion 521 will force on the first free end 411 and the engaging portion 522 will force on the second free end 421, because the engaging unit 400 is lowered to a position between the first position and the second position, the pawl arms 470 are engaged with the inner teeth 230, and before being disengaged with the inner teeth 230 in the fastening direction A2, the pawl arms 470 must be deformed in the radial direction.

It is noted that an anti-deformed capability along the radial direction of each of the first retaining portion 410 and the second retaining portion 420 is smaller than an anti-deformed capability along the radial direction of the pawl arm 470; hence, the first free end 411 and the second free end 421 will be deformed first because they cannot bear the force, and the engaging portions 521, 522 can return to the position shown in FIG. 4A, such that the engaging unit 400 can be changed from the second position to the first position.

In other embodiment, the structure of the first retaining portion 410 and the second retaining portion 420 can be changed, and in addition to engage with the knob, the retaining portion can engaged with the base, only when the retaining portion has capability to remain the relative position between the knob and the engaging unit to prevent the engaging unit from being lifted or lowered by an external force. The number of the retaining portion and the number of the engaging portion are not limited.

Figure 5:
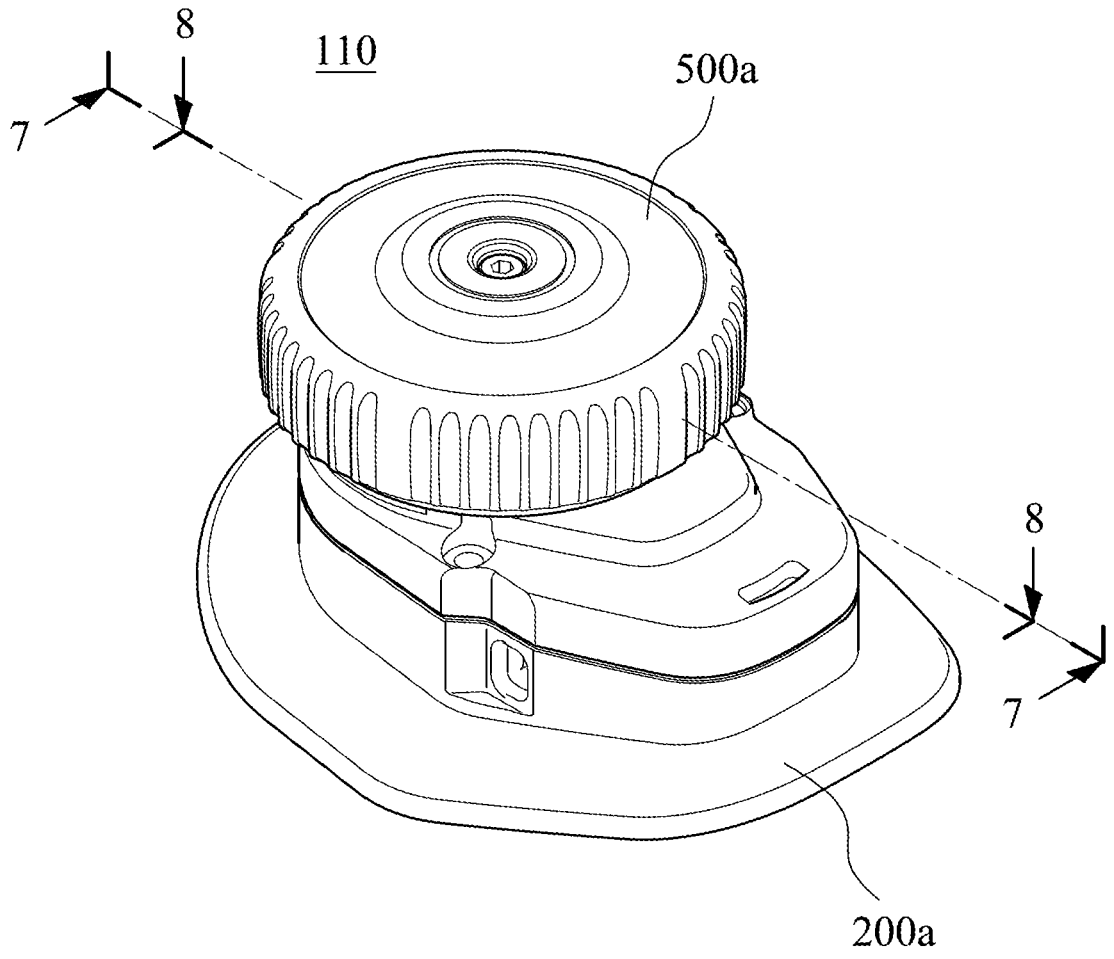
FIG. 5 shows a three-dimensional schematic view of a fastening device according to another embodiment of the present disclosure.
Figure 6A:
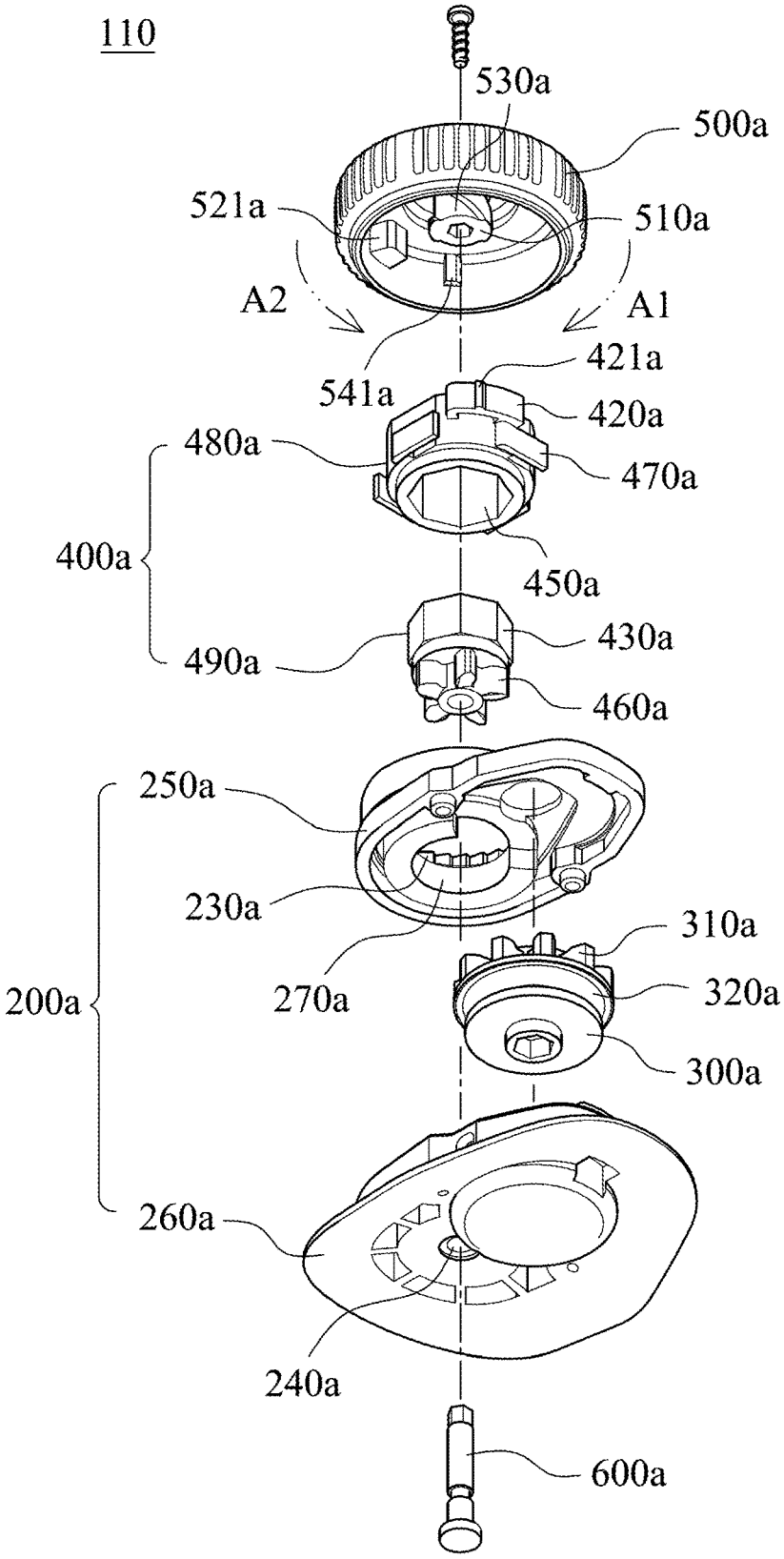
FIG. 6A shows one exploded view of the fastening device of FIG. 5.
Figure 6B:
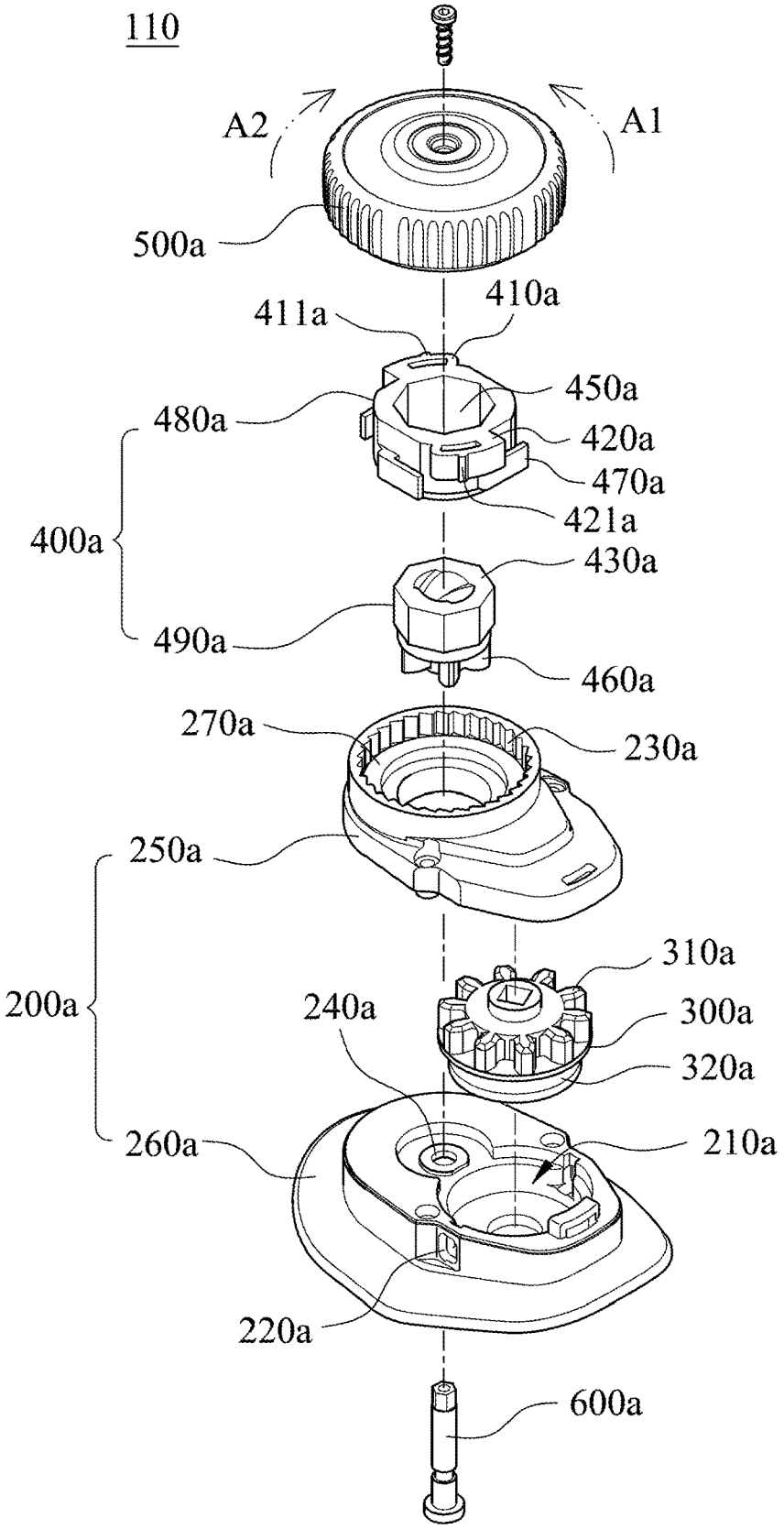
FIG. 6B shows another exploded view of the fastening device of FIG. 5.

Please refer to FIG. 5, FIG. 6A and FIG. 6B, wherein FIG. 5 shows a three-dimensional schematic view of a fastening device 110 according to another embodiment of the present disclosure, FIG. 6A shows one exploded view of the fastening device 110 of FIG. 5, and FIG. 6B shows another exploded view of the fastening device 110 of FIG. 5. The fastening device 110 includes a base 200*a*, a spool 300*a*, an engaging unit 400*a* and a knob 500*a*. The structure and the operation of the fastening device 110 will be described in detail in the following paragraphs.

In the embodiment, the base 200*a* includes an upper base portion 250*a* and a lower base portion 260*a*, the upper base portion 250*a* includes a through hole 270*a* and a plurality of inner teeth 230*a*, the inner teeth 230*a* are disposed at a wall of the through hole 270*a*, which is near the knob 500*a*, the lower base portion 260*a* includes a receiving space 210*a* (shown in FIG. 6B), two lace holes 220*a* and an opening 240*a*, the two lace holes 220*a* are communicated with the receiving space 210*a* and allow two ends of a lace (not shown) to pass therethrough to connect to the spool 300*a*, and when the upper base portion 250*a* is assembled with the lower base portion 260*a*, the opening 240*a* is communicated with the through hole 270*a*.

The spool 300*a* has a structure similar to the structure of the embodiment shown in FIG. 2A, and includes an annular track 320*a* and a plurality of mounted teeth 310*a*, the mounted teeth 310*a* are engaged with the engaging unit 400*a*, and the spool 300*a* is disposed inside the receiving space 210*a*.

The engaging unit 400*a* includes a lifted member 490*a* and an engaging member 480*a*, the lifted member 490*a* includes a guiding portion 430*a* and a plurality of engaged teeth 460*a*, the engaged teeth 460*a* are disposed at one end of the guiding portion 430*a*, the engaging member 480*a* is ring-shaped and has a radial direction (not shown), the engaging member 480*a* includes a first retaining portion 410*a* (shown in FIG. 6B), a second retaining portion 420*a*, four pawl arms 470*a* and a communicating hole 450*a*, the first retaining portion 410*a* includes a first protrusion 411*a* (shown in FIG. 6B), and the second retaining portion 420*a* includes a second protrusion 421*a*. The lifted member 490*a* is engaged with the communicating hole 450*a*, and is coupled to the knob 500*a* via the guiding portion 430*a*.

The knob 500*a* includes a cylinder 510*a*, two engaging portions 521*a*, 522*a* (shown FIG. 8A), two abutting portions 541*a*, 542*a* (shown FIG. 8A) and a spiral track 530*a*. The two engaging portions 521*a*, 522*a* and the two abutting portions 541*a*, 542*a* are spaced in an inner wall (not labeled) of the knob 500*a*, the cylinder 510*a* is protruded toward the base 200*a*, and the spiral track 530*a* is disposed at the cylinder 510*a*. The cylinder 510*a* is coupled to the guiding portion 430*a* when assembling, and the lifted member 490*a* can be lifted or lowered relative to the knob 500*a* when the guiding portion 430*a* is moved along the spiral track 530*a*.

When assembling, the spool 300*a* is disposed inside the receiving space 210*a*, the upper base portion 250*a* is covered on the lower base portion 260*a*, then the engaging unit 400*a* is disposed in the through hole 270*a* to allow the engaged teeth 460*a* and the pawl arms 470*a* to be engaged with the mounted teeth 310*a* and the inner teeth 230*a*, respectively, the cylinder 510*a* of the knob 500*a* can be correspondingly screwed into the guiding portion 430*a*, such that the guiding portion 430*a* is coupled to the spiral track 530*a*, finally, the elements are assembled by a fastening member including a connecting post 600*a* and a screw (not shown), the connecting post 600*a* is passed through the opening 240*a* and the engaging unit 400*a* to engage with the cylinder 510*a*, and the screw is fastened therein to complete the assembly.

Figure 7A:
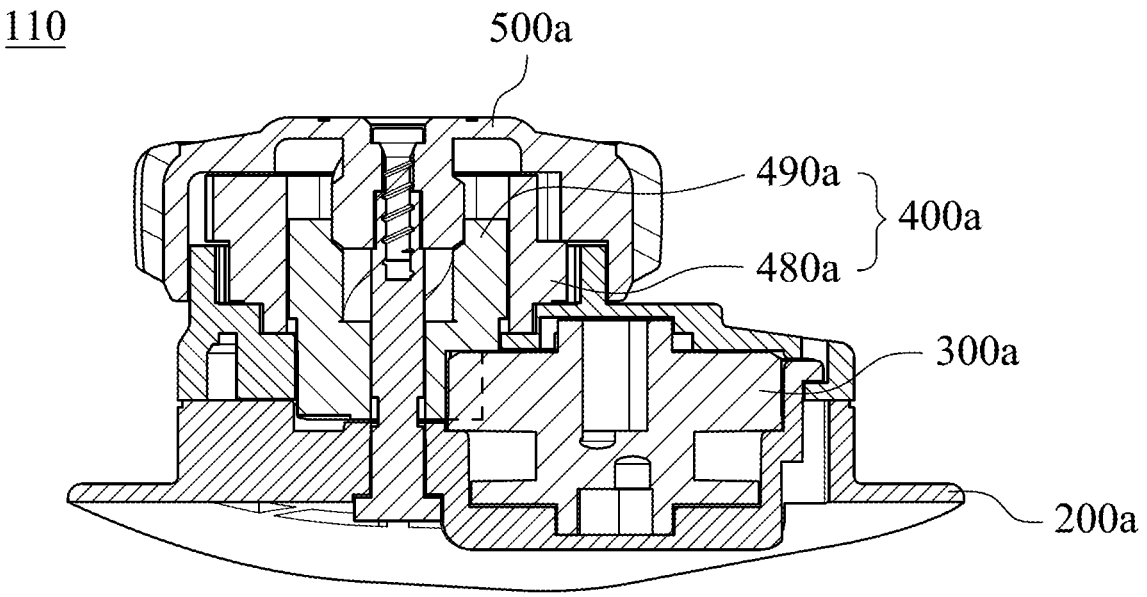
FIG. 7A shows one cross-sectional view of the fastening device of FIG. 5 taken along line 7-7.
Figure 7B:
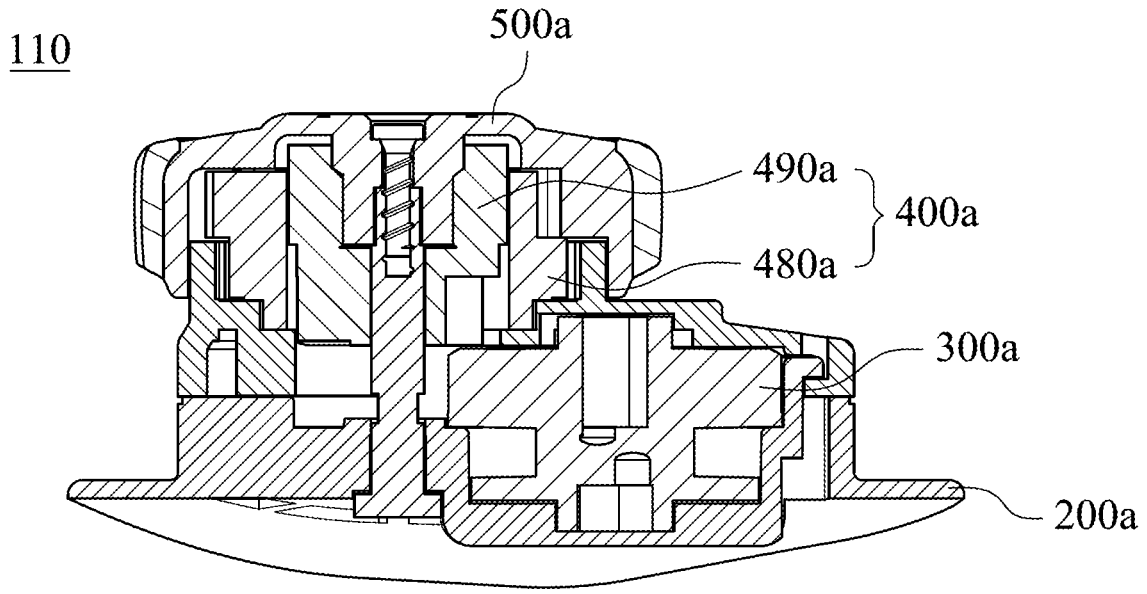
FIG. 7B shows another cross-sectional view of the fastening device of FIG. 5 taken along Line 7-7.

Please refer to FIG. 7A and FIG. 7B, and also refer to FIG. 6A and FIG. 6B, wherein FIG. 7A shows one cross-sectional view of the fastening device 110 of FIG. 5 taken along line 7-7, and FIG. 7B shows another cross-sectional view of the fastening device 110 of FIG. 5 taken along Line 7-7.

As shown in FIG. 7A, the guiding portion 430*a* (shown in FIG. 6B) can be limitedly moved along the spiral track 530*a* (shown in FIG. 6B), in other words, when the knob 500*a* is rotated relative to the engaging unit 400*a*, the guiding portion 430*a* will be moved along the spiral track 530*a*, such that the engaging unit 400*a* is lifted or lowered to be at a first position or a second position.

As shown in FIG. 7A, the engaging unit 400*a* is at the first position, and the engaged teeth 460*a* (shown in FIG. 6A) is engaged with the mounted teeth 310*a* (shown in FIG. 6A). The pawl arms 470*a* (shown in FIG. 6B) are engaged with the inner teeth 230*a* (shown in FIG. 6B), the pawl arms 470*a* will be disengaged with the inner teeth 230*a* in the tightening direction A2 (shown in FIG. 6B) while engaged with the inner teeth 230*a* in the releasing direction A1 (shown in FIG. 6B) owning to the structure thereof, such that the engaging unit 400*a* can be driven to link up with the spool 300*a* by rotating the knob 500*a* toward the tightening direction A2, such that the lace is retracted, and when the knob 500*a* is stopped, the pawl arms 470*a* are engaged with the inner teeth 230*a* to prohibit the lifted member 490*a* from rotating toward the releasing direction A1, such that securing purpose is achieved.

As shown in FIG. 7B, when the guiding portion 430*a* is moved to change the engaging unit 400*a* to the second position by rotating the knob 500*a*, the engaged teeth 460*a* are disengaged with the mounted teeth 310*a*, therefore, the spool 300*a* will not be limited and can be rotated in the any direction inside the receiving space 210; and the lace can be pulled so as to be released.

Figure 8A:
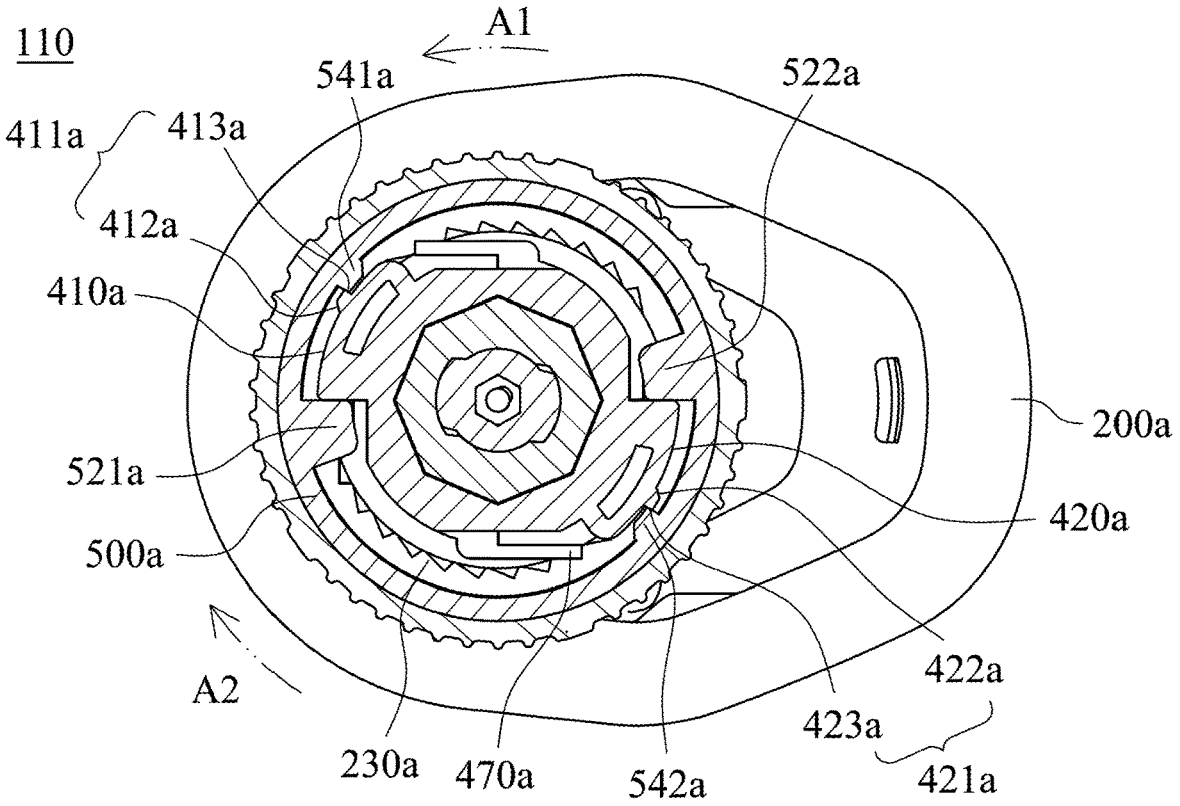
FIG. 8A shows one cross-sectional view of the fastening device of FIG. 5 taken along Line 8-8.
Figure 8B:
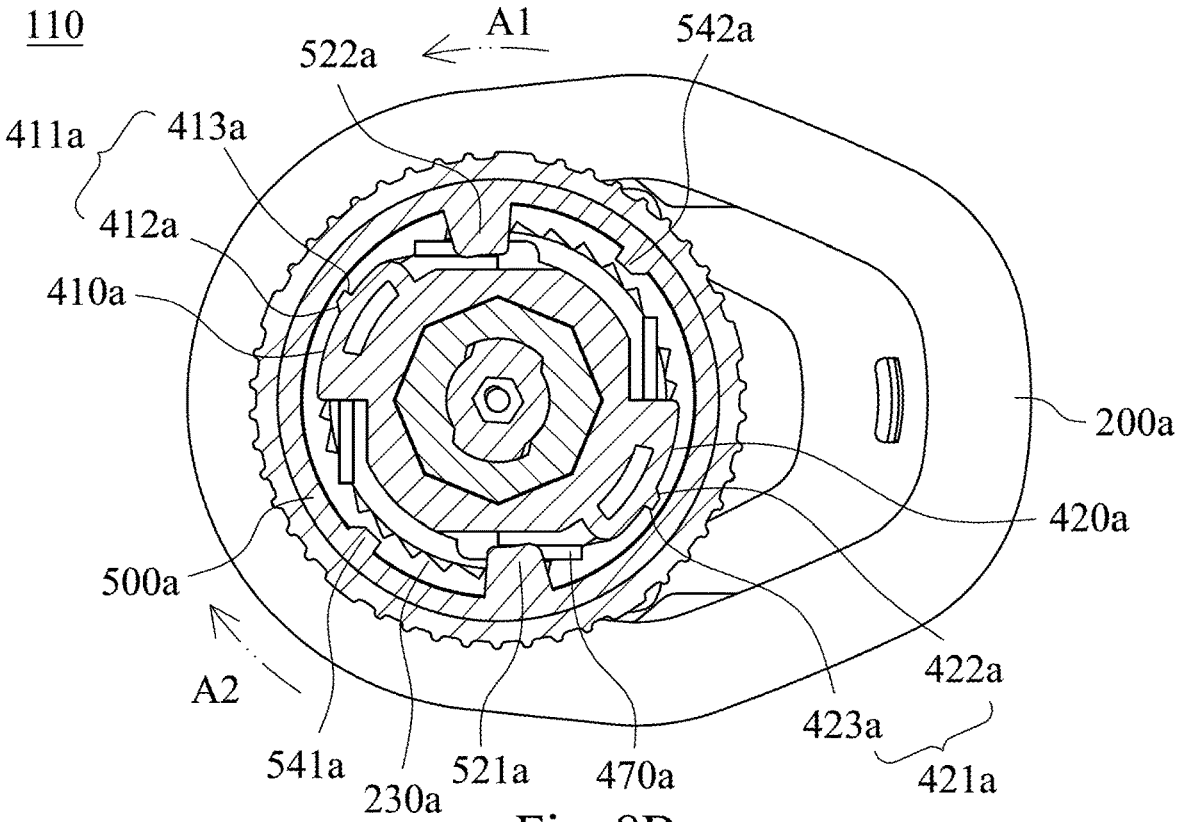
FIG. 8B shows another cross-sectional view of the fastening device of FIG. 5 taken along Line 8-8.

Please refer to FIG. 8A and FIG. 8B, wherein FIG. 8A shows one cross-sectional view of the fastening device 110 of FIG. 5 taken along Line 8-8, and FIG. 8B shows another cross-sectional view of the reel device 110 of FIG. 5 taken along Line 8-8.

As shown in FIG. 8A, when the knob 500*a* is rotated in the fastening direction A2, the engaging portion 521*a* is abutted against the first retaining portion 410*a*, the abutted portion 541*a* is abutted against a first end 413*a* of the first protrusion 411*a*, the engaging portion 522*a* is abutted against the second retaining portion 420*a*, the abutted portion 542*a* is abutted against a first end 423*a* of the second protrusion 421*a*, such that the knob 500*a* is engaged with the engaging unit 400*a*, precisely, engaged with the lifted member 490*a*, such that rotation of the knob 500*a* can cause driven of the engaging unit 400*a* to move the spool 300*a* toward the tightening direction A2 for retracting lace.

Oppositely, when the knob 500*a* is stopped, the first retaining portion 410*a* and the second retaining portion 420*a* can be abutted against the engaging portions 521*a*, 522*a*, the abutted portion 541*a* and the abutted portion 542*a*, respectively, owing to the structure thereof, such that the relative position between the knob 500*a* and the engaging unit 400*a* is remained. Such structure can prevent the knob 500*a* from driving the engaging unit 400*a* to lead the engaging unit 400*a* to switch to the second position when an external force exerted on the fastening device 110, such that the lace will not be loosen.

When the knob 500*a* is rotated in the releasing direction A1, due to the engagement of the pawl arms 470*a* and the inner teeth 230*a*, rotation of the engaging unit 400*a* is limited, the abutted portion 541*a* will press the first protrusion 411*a* of the first retaining portion 410*a*, the abutted portion 542*a* will press the second protrusion 421*a* of the second retaining portion 420*a*, the first retaining portion 410*a* and the second retaining portion 420*a* are moved in the radial direction because they cannot bear the force, as shown in FIG. 8B, the first protrusion 411*a* and the second protrusion 421*a* is not abutted, the knob 500*a* is allowed to be rotated relative to the engaging unit 400*a* in the releasing direction A1, such that the lifted member 490*a* is lifted along the spiral track 530*a*, the engaged teeth 460*a* are disengaged with the mounted teeth 310*a*, finally the engaging unit 400*a* will not be affected by the engaging unit 400*a*, and the engaging unit 400*a* can be at the second position.

In addition, if the knob 500*a* is rotated in the tightening direction A2, the abutting portion 541*a* will force on a second end 412*a* of the first protrusion 411*a*, the abutting portion 541*a* will force on a second end 422*a* of the second protrusion 421*a*, because an anti-deformed capability along the radial direction of each of the first retaining portion 410*a* and the second retaining portion 420*a* is smaller than an anti-deformed capability along the radial direction of the pawl arm 470*a*, the first retaining portion 410*a* is deformed inwardly to allow the abutted portion 541*a* to pass the first protrusion 411*a* to abut against the first end 413*a* of the first protrusion 411*a*, and the second retaining portion 420*a* is deformed inwardly to allow the abutted portion 542*a* to pass the second protrusion 421*a* to abut against the first end 423*a* of the second protrusion 421*a*, meanwhile, the first retaining portion 410*a* and the second retaining portion 420*a* can restore and return to the condition shown in FIG. 8A.

Figure 9:
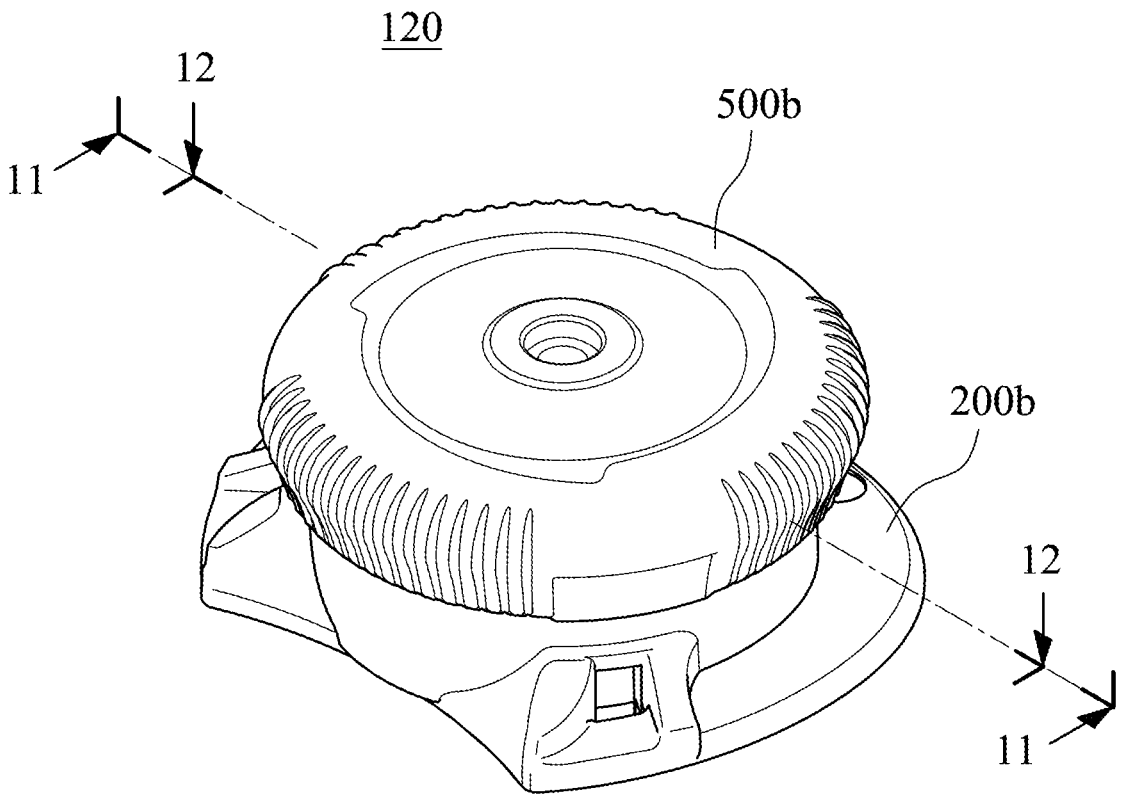
FIG. 9 shows a three-dimensional schematic view of a fastening device according to yet another embodiment of the present disclosure.
Figure 10A:
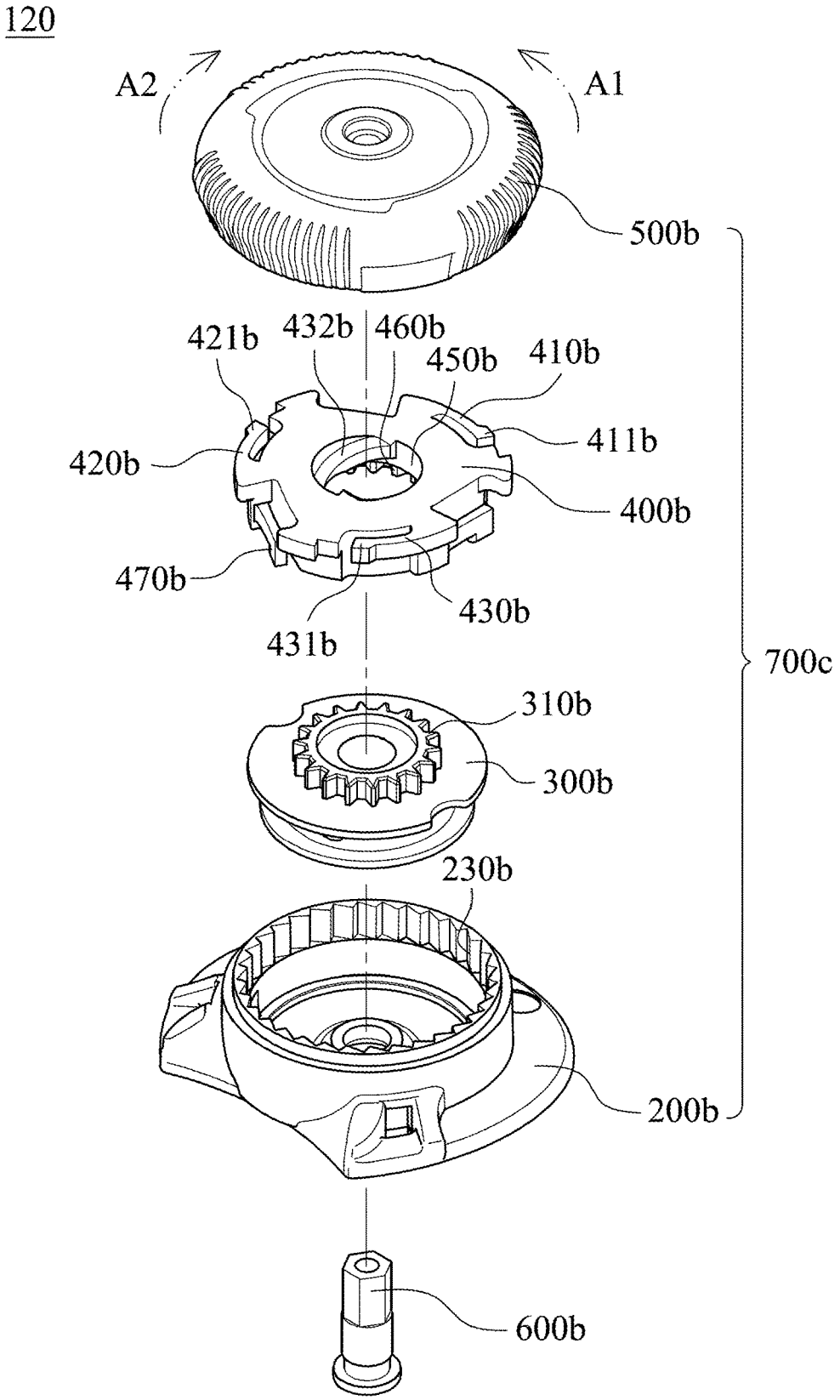
FIG. 10A shows one exploded view of the fastening device of FIG. 9.
Figure 10B:
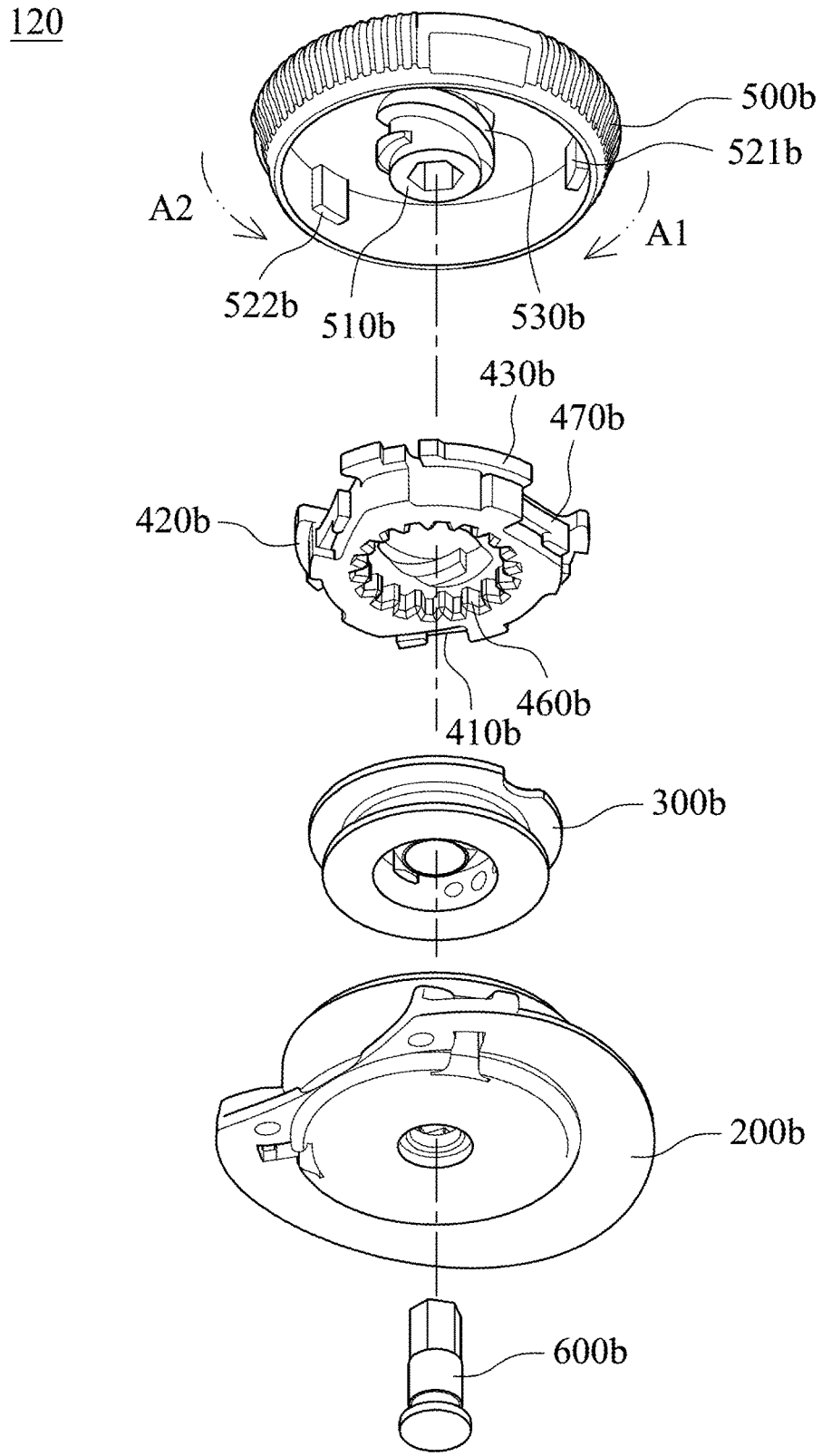
FIG. 10B shows another exploded view of the fastening device of FIG. 9.

Please refer to FIG. 9, FIG. 10A and FIG. 10B, wherein FIG. 9 shows a three-dimensional schematic view of a fastening device 120 according to yet another embodiment of the present disclosure, FIG. 10A shows one exploded view of the fastening device 120 of FIG. 9, and FIG. 10B shows another exploded view of the fastening device 120 of FIG. 9. The fastening device 120 includes a main part 700*c* and a fastening member (not labeled), the main part 700*c* is composed of a base 200*b*, a spool 300*b*, a knob 500*b* and an engaging unit 400*b*, the fastening member is disposed at the main part 700*c* to allow the base 200*b*, the spool 300*b*, the knob 500*b* and the engaging unit 400*b* to be assembled, and the structure and the operation of the fastening device 120 is similar to the structure and the operation of the embodiment of FIGS. 1 to 2B.

The base 200*b* includes a plurality of inner teeth 230*b*, the spool 300*b* is disposed at the base 200*b* and includes a plurality of mounted teeth 310*b*, the engaging unit 400*b* is ring-shaped and has a radial direction (not shown), and the engaging unit 400*b* includes a first retaining portion 410*b*, a second retaining portion 420*b*, a third retaining portion 430*b*, a guiding portion 432*b*, three stopping portions 441*b*, 442*b*, 443*b*, a communicating hole 450*b*, a plurality of engaged teeth 460*b* and three pawl arms 470*b*. The guiding portion 432*b* is coupled to the knob 500*b*, the pawl arms 470*b* are engaged with the inner teeth 230*b*, the engaged teeth 460*b* are disposed at the wall of the communicating hole 450*b*, which is near the base 200*b*, the three stopping portions 441*b*, 442*b*, 443*b*, are formed at an outer wall of the engaging unit 400*b*, which is near the knob 500*b*.

The first retaining portion 410*b*, the second retaining portion 420*b* and the third retaining portion 430*b* can be deformed in the radial direction and have restoring capability, the first retaining portion 410*b* has a first free end 411*b*, the second retaining portion 420*b* has a second free end 421*b*, the third retaining portion 430*b* has a third free end 431*b*, when each of the first free end 411*b*, the second free end 421*b* and the third free end 431*b* bears a force exerted thereon larger than the force which the first free end 11*b*, the second free end 421*b* and the third free end 431*b* can bear, the first free end 411*b*, they deformed in the radial direction, and When the force disappears, the first free end 411*b*, the second free end 421*b* and the third free end 431*b* can restore.

The knob 500*b* includes a cylinder 510*b*, three engaging portions 521*b*, 522*b*, 523*b* (shown in FIG. 11A), and a spiral track 530*b*, the spiral track 530*b* is disposed at the cylinder 510*b*, when the engaging unit 400*b* is at the first position, the engaging portion 521*b* is abutted against the first retaining portion 410*b*, the engaging portion 522*b* is abutted against the second retaining portion 420*b*, and the engaging portion 523*b* is abutted against the third retaining portion 430*b*.

The fastening member of the embodiment includes a connecting post 600*b* and a screw (not shown). The fastening method is the same with the embodiment shown in FIG. 2A, and will not be describe again.

Figure 11A:
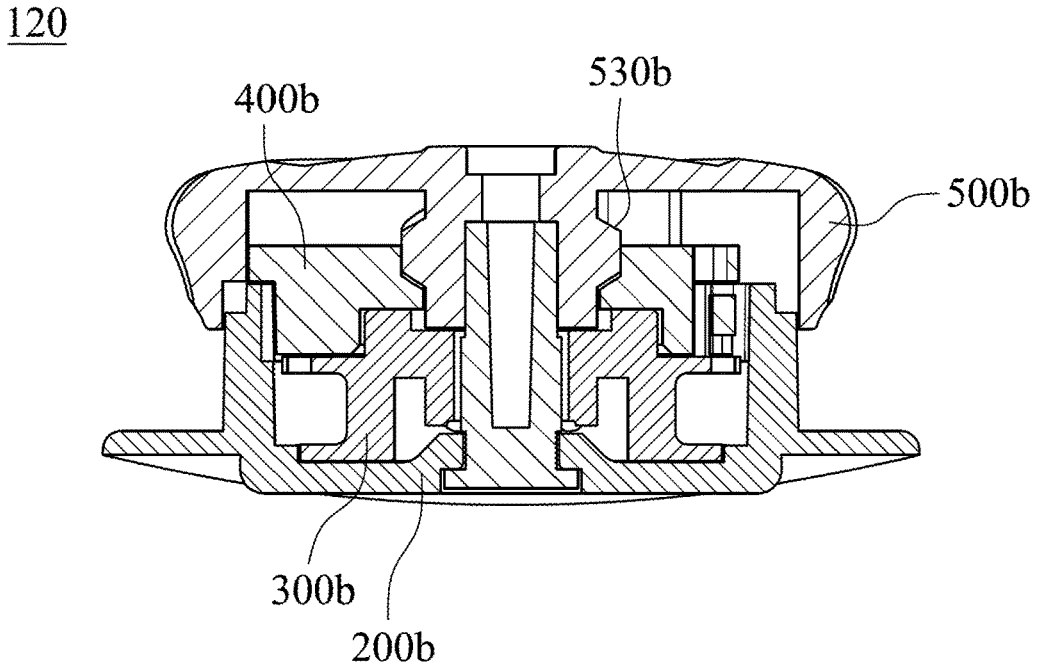
FIG. 11A shows one cross-sectional view of the fastening device of FIG. 9 taken along line 11-11.
Figure 11B:
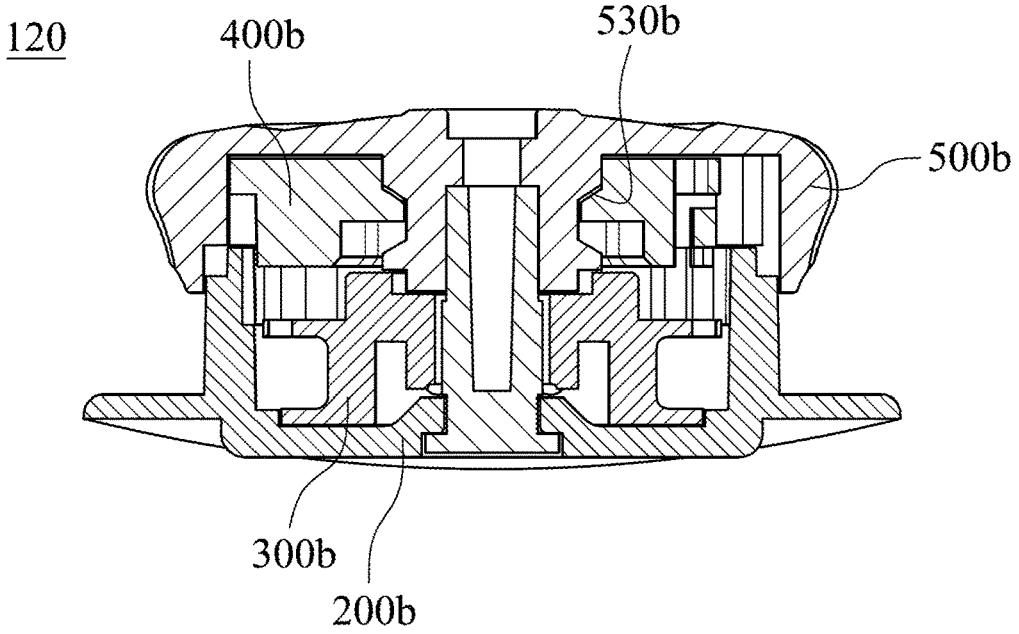
FIG. 11B shows another cross-sectional view of the fastening device of FIG. 9 taken along Line 11-11.

Please refer to FIG. 11A and FIG. 11B, and also refer to FIG. 10A and FIG. 10B, FIG. 11A shows one cross-sectional view of the fastening device 120 of FIG. 9 taken along line 11-11, and FIG. 11B shows another cross-sectional view of the fastening device 120 of FIG. 9 taken along Line 11-11.

Because the guiding portion 432*b* (shown in FIG. 10B) can be moved along the spiral track 530*b*, the engaging unit 400*b* can be lifted or lowered relative to the knob 500*b* by moving the guiding portion 432*b* along the spiral track 530*b* As shown in FIG. 11A, the engaging unit 400*b* is at the first position, the pawl arms 470*b* (shown in FIG. 10A) will selectively engaged with the inner teeth 230*b* (shown in FIG. 10A), and rotation of the spool 300*b* in the releasing direction A1 (shown in FIG. 10A) is restricted.

As shown in FIG. 11B, the engaging unit 400*b* can be at the second position by move the guiding portion 432*b* via the rotation of the knob 500*b*, the pawl arms 470*b* are disengaged with the inner teeth 230*b*, because the pawl arms 470 are disengaged with the inner teeth 230*b*, the rotation of the spool 300*b* in the releasing direction A1 is not restricted, as a result, the lace can be pulled and released.

Figure 12A:
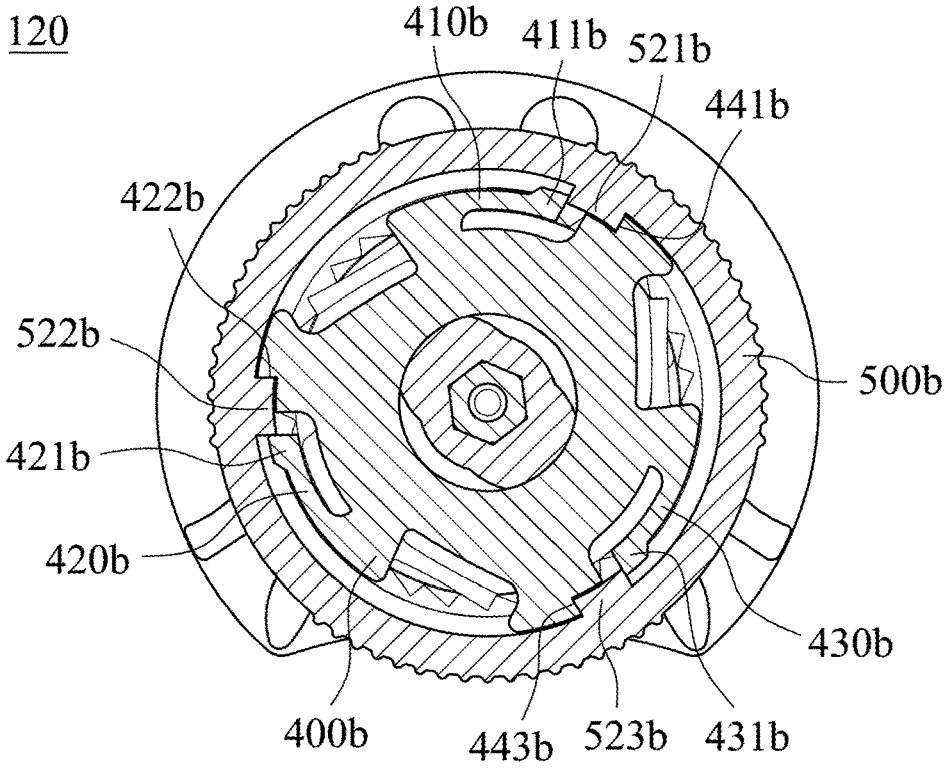
FIG. 12A shows one cross-sectional view of the fastening device of FIG. 9 taken along Line 12-12.
Figure 12B:
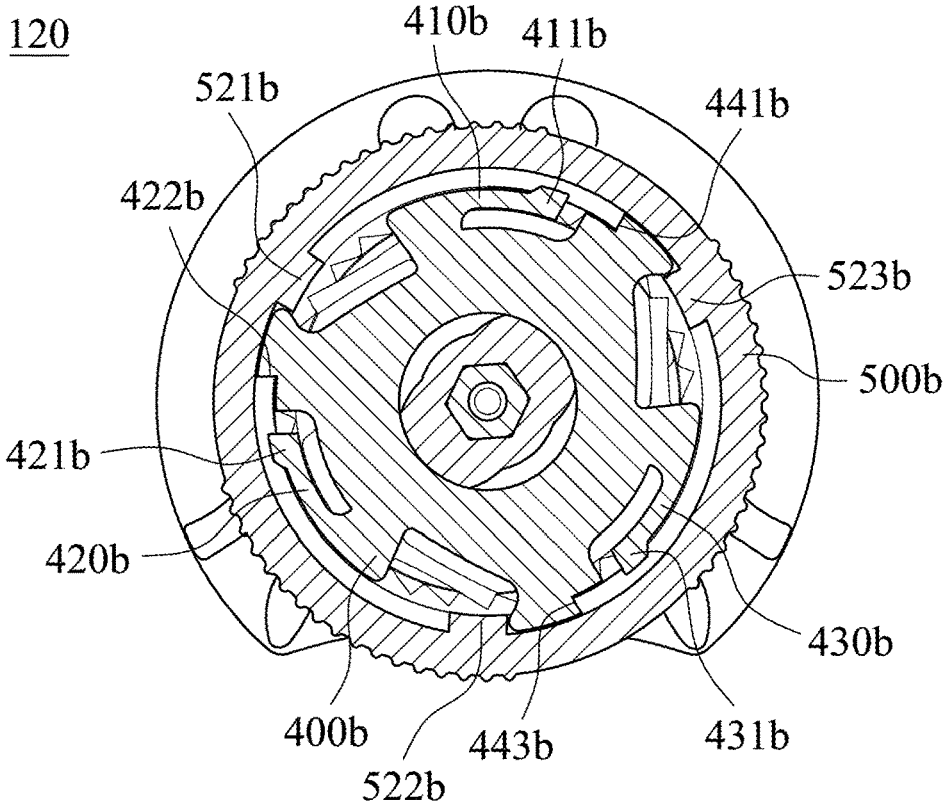
FIG. 12B shows another cross-sectional view of the fastening device of FIG. 9 taken along Line 12-12.

Please refer to FIG. 12A and FIG. 12B, wherein FIG. 12A shows one cross-sectional view of the fastening device 120 of FIG. 9 taken along Line 12-12, and FIG. 12B shows another cross-sectional view of the fastening device 120 of FIG. 9 taken along Line 12-12.

As shown in FIG. 12A, the engaging unit 400*b* is at the first position, the engaging portion 521*b* is abutted against the first retaining portion 410*b*, the stopping portion 441*b*, the engaging portion 522*b* is abutted against the second retaining portion 420*b* and the stopping portion 442*b*, the engaging portion 523*b* is abutted against the third retaining portion 430*b* and the stopping portion 443*b*, hence, the knob 500*b* is engaged with the engaging unit 400*b*, when the engaging unit 400*b* is rotated in the tightening direction A2, the engaging portion 521*b* forces on the stopping portion 441*b*, the engaging portion 522*b* forces on the stopping portion 442*b*, the engaging portion 523*b* forces on the stopping portion 443*b*, such that the engaging unit 400*b* can be rotated. On the other hand, when the knob 500*b* is stopped, the first retaining portion 410*b*, the second retaining portion 420*b* and the third retaining portion 430*b* can be abutted against the engaging portions 521*b*, 522*b*, 523*b*, respectively, to remain the relative position between the knob 500*b* and the engaging unit 400*b* owing to the structure thereof.

When the knob 500*b* is rotated in the releasing direction A1, because the pawl arms 470*b* are engaged with the inner teeth 230*b*, rotation of the engaging unit 400*b* is restricted, the engaging portion 521*b* will press the first free end 411*b* of the first retaining portion 410*b*, the engaging portion 522*b* will press the second free end 421*b* of the second retaining portion 420*b*, the engaging portion 523*b* will press the third free end 431*b* of the third retaining portion 430*b*, the first free end 411*b*, the second free end 421*b* and the third free end 431*b* are moved in the radial direction because they cannot bear the force, and as shown in FIG. 12B, the knob 500*b* can be rotated relative to the engaging unit 400*b*.

In addition, if the knob 500*b* is rotated in the tightening direction A2, the engaging portion 521*b* will force on a first free end 411*b*, the engaging portion 522*b* will force on a second free end 421*b*, the engaging portion 523*b* will force on a third free end 431*b*, and the first free end 411*b*, the second free end 421*b*, and the third free end 431*b* will be moved in the radial direction first, and then restore and return to the condition shown in FIG. 12A.

To sum up, the present disclosure has the following advantages.

1. Through the configuration and engagement of the guiding portion and the spiral track, the engaging unit can change position via the rotation of the knob, such that fastening or releasing condition thereof can be changed.

2. Through configuration of the first retaining portion, a relative position between the engaging unit and the knob, i.e., the first position and the second position, can be remained, and the release of the lace owing to an external force in the environment can be prevented.

3. Because an anti-deformed capability along the radial direction of each of the first retaining portion and the second retaining portion is smaller than an anti-deformed capability along the radial direction of the pawl arm, the first retaining portion and the second retaining portion can be bended to allow the engaging unit to change from the first position to the second position along the spiral track while a relative position between the engaging unit and the knob can be remained.

4. Because the main part of the fastening device is composed of the base, the spool, the knob and the engaging unit, the structure thereof is simplified, and the cost as well as the manufacturing difficulty can be reduced.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A fastening device, characterized by, the fastening device comprising a main part and a fastening member, the main part composed of a base, a spool, a knob and an engaging unit, the fastening member disposed at the main part such that the base, the spool, the knob and the engaging unit are assembled, wherein:

the spool is disposed at the base, and a lace is wound around the spool;

the knob is disposed at the base, and the knob comprises a spiral track;

the engaging unit is coupled to the spool, and the engaging unit comprises a guiding portion coupled to the spiral track; and the guiding portion is limitedly moved along the spiral track by rotating the knob, such that the engaging unit is lifted or lowered to switch between a first position and a second position relative to the knob, the engaging unit prohibits the spool from rotating toward a releasing direction when the engaging unit is at the first position, and the engaging unit allows the spool to be rotated toward the releasing direction when the engaging unit is at the second position.

2. The fastening device of claim 1, characterized by, wherein the engaging unit further comprises a pawl arm, one of the base and the spool comprises a plurality of inner teeth, when the engaging unit is at the first position, the pawl arm is engaged with the inner teeth in the releasing direction to prohibit the spool from rotating, and the pawl arm is disengaged with the inner teeth in a tightening direction opposite to the releasing direction.

3. The fastening device of claim 2, characterized by, wherein the engaging unit further comprises a first retaining portion and a second retaining portion, the engaging unit is ring-shaped and has a radial direction, and each of the first retaining portion and the second retaining portion has a restoring capability in the radial direction.

4. The fastening device of claim 3, characterized by, wherein an anti-deformed capability along the radial direction of each of the first retaining portion and the second retaining portion is smaller than an anti-deformed capability along the radial direction of the pawl arm.

5. The fastening device of claim 4, characterized by, wherein the knob further comprises two engaging portions, and the two engaging portions abut the first retaining portion and the second retaining portion, respectively, when the engaging portions are at the first position.

6. A fastening device, characterized by, comprising:

a base;

a spool, disposed at the base, and a lace is wound around the spool;

a knob, disposed at the base, and the knob comprising:

a spiral track; and an engaging unit, coupled to the spool, and the engaging unit comprising:

a guiding portion, coupled to the spiral track; and a first retaining portion coupled to the knob or the base;

wherein the guiding portion is limitedly moved along the spiral track by rotating the knob, such that the engaging unit is lifted or lowered to switch between a first position and a second position relative to the knob, the first retaining portion is coupled to the knob or the base to allow the engaging unit to be remained at the first position or the second position, the engaging unit allows the spool to be rotated toward a releasing direction when the engaging unit is at the second position, and the engaging unit prohibits the spool from rotating toward the releasing direction when the engaging unit is at the first position.

7. The fastening device of claim 6, characterized by, wherein the engaging unit further comprises a pawl arm, one of the base and the spool comprises a plurality of inner teeth, when the engaging unit is at the first position, the pawl arm is engaged with the inner teeth in the releasing direction to prohibit the spool from rotating, and the pawl arm is disengaged with the inner teeth in a tightening direction opposite to the releasing direction.

8. The fastening device of claim 7, characterized by, wherein the engaging unit further comprises a second retaining portion, the engaging unit is ring-shaped and has a radial direction, and each of the first retaining portion and the second retaining portion has a restoring capability in the radial direction.

9. The fastening device of claim 8, characterized by, wherein an anti-deformed capability along the radial direction of each of the first retaining portion and the second retaining portion is smaller than an anti-deformed capability along the radial direction of the pawl arm.

10. The fastening device of claim 9, characterized by, wherein the knob further comprises two engaging portions, and the two engaging portions abut the first retaining portion and the second retaining portion, respectively, when the engaging portions are at the first position.

11. The fastening device of claim 6, characterized by, wherein the engaging unit further comprises a plurality of engaged teeth, the spool comprises a plurality of mounted teeth, and the mounted teeth are engaged with the engaged teeth at the first position.

12. The fastening device of claim 11, characterized by, wherein the base comprises a plurality of inner teeth, and the engaging unit further comprises:

a lifted member, comprising the guiding portion and the engaged teeth; and an engaging member, coupled to the lifted member, and the engaging member comprising the first retaining portion and a plurality of pawl arms;

wherein when the engaging unit is at the first position, the pawl arms is engaged with the inner teeth in the releasing direction to prohibit the spool from rotating, the pawl arms are disengaged with the inner teeth in a tightening direction opposite to the releasing direction, and the first retaining portion is coupled to the knob to allow the engaging unit to be remained at the first position.

13. The fastening device of claim 12, characterized by, wherein when the engaging unit is at the second position, the engaged teeth are disengaged with the mounted teeth.

* * * * *